US006382073B1

(12) United States Patent
Beretta

(10) Patent No.: US 6,382,073 B1
(45) Date of Patent: May 7, 2002

(54) GAS OPERATED SHOTGUN

(75) Inventor: Ugo Gussalli Beretta, Brescia (IT)

(73) Assignee: Fabbrica d'Armi P. Beretta S.P.A. (IT)

( * ) Notice: Subject to any disclaimer, the term of this patent is extended or adjusted under 35 U.S.C. 154(b) by 0 days.

(21) Appl. No.: 09/730,456

(22) Filed: Dec. 5, 2000

(30) Foreign Application Priority Data

Dec. 10, 1999 (IT) ..... BS99A0113

(51) Int. Cl.[7] ..... F41A 5/18
(52) U.S. Cl. ..... 89/193; 89/191.01; 89/191.02
(58) Field of Search ..... 89/191.01, 191.02, 89/192, 193

(56) References Cited

U.S. PATENT DOCUMENTS

| | | | | | |
|---|---|---|---|---|---|
| 1,846,993 | A | * | 2/1932 | Destree | 89/193 |
| 2,186,582 | A | * | 1/1940 | Gebauer | 42/3 |
| 3,443,477 | A | * | 5/1969 | Kaempf | 89/128 |
| 3,601,002 | A | * | 8/1971 | Janson | 89/191 |
| 3,618,457 | A | * | 11/1971 | Miller | 89/185 |
| 3,945,296 | A | * | 3/1976 | Hyytinen | 89/191 A |
| 3,990,348 | A | * | 11/1976 | Vesamaa | 89/193 |
| 4,085,654 | A | * | 4/1978 | Panigoni | 89/191 A |
| 4,324,170 | A | * | 4/1982 | Healy | 89/159 |
| 5,429,034 | A | * | 7/1995 | Badali et al. | 89/193 |
| 5,872,323 | A | * | 2/1999 | Norton et al. | 89/191.2 |

FOREIGN PATENT DOCUMENTS

| | | | | |
|---|---|---|---|---|
| DE | 714566 | * | 11/1941 | 89/193 |
| EP | 0634620 A1 | * | 1/1995 | F41A/5/28 |

* cited by examiner

*Primary Examiner*—Michael J. Carone
*Assistant Examiner*—Gabriel S Sukman
(74) *Attorney, Agent, or Firm*—McGlew and Tutle, P.C.

(57) ABSTRACT

The invention concerns a gas operated shotgun made up of a barrel (11) a cylinder (12) attached to the barrel and a piston (13) moving in the cylinder and along the guide rod (16) between an advanced rest position and an active retracted control position for certain functional operations of the shotgun. The inside of the barrel communicates with the cylinder through at least one inlet (14) for of a part of the propulsion gasses due to the movement of the piston to the active retracted position. A protective flap (20) extends into the cylinder chamber towards the piston on the front of the same, which is placed in front of the gas entrance hole (14) in said cylinder chamber partially covering and protecting the guide rod (16) of the piston. The piston can also be furnished with a scraper (22) to clean the rod.

8 Claims, 1 Drawing Sheet

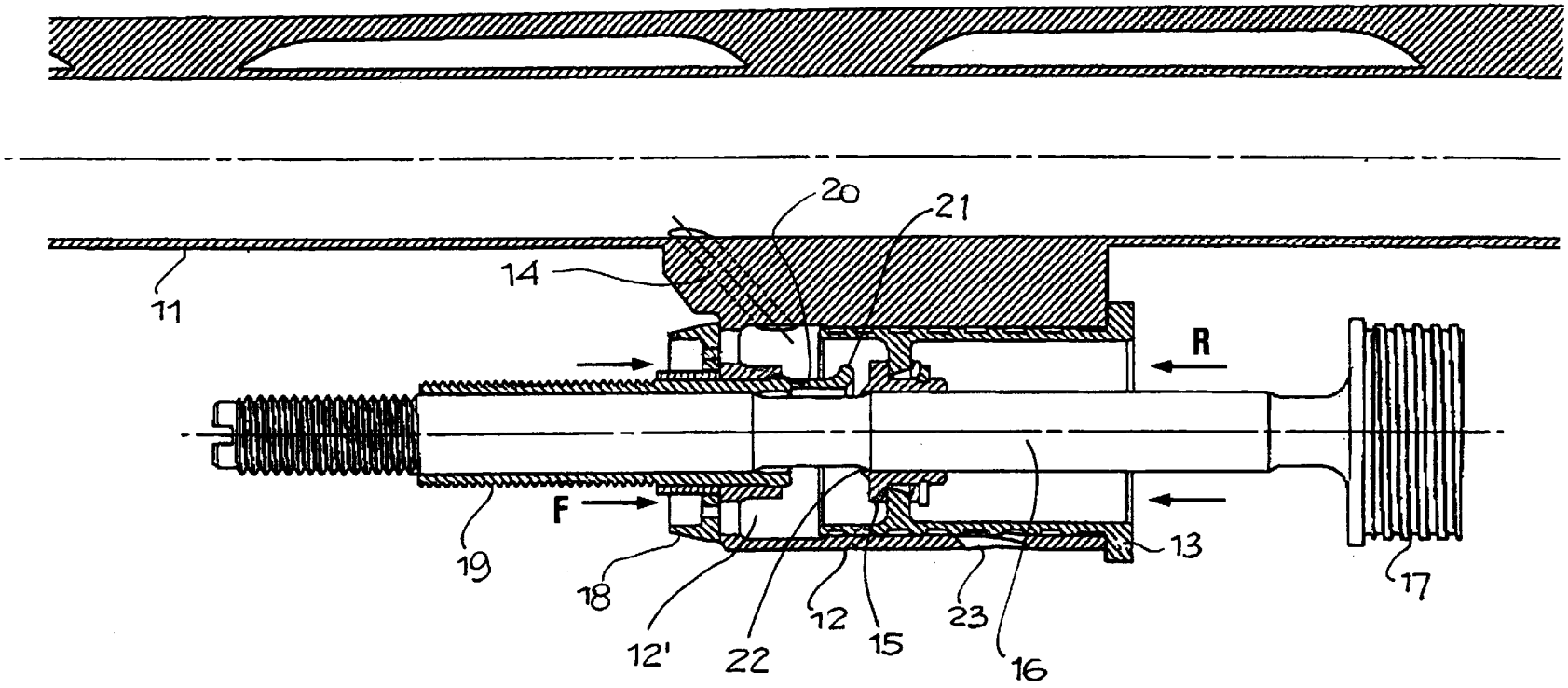
17
R
13
16
23
21
15
20
12
22
12'
18
14
F
19
11

GAS OPERATED SHOTGUN

The present invention regards the semi-automatic shotgun sector in general and in particular refers to a shotgun with a gas powered system to operate some of its functions.

It is well known that in shotguns having a gas operated system, a part of the gas projecting the cartridge is deviated, through at least one opening, leading from the barrel of the gun to a cylinder/piston unit attached to the barrel. The piston consequently moves in the cylinder due to the pressure of the gas, moving it from a forward rest position to a retracted position, engaging the action of a return spring. By moving into this retracted position, the piston exerts a pressure on a coupling and subsequently on parts which move back towards a tubular ammunition tank so as to carry out, as is well known, different functions such as the ejection of the fired cartridge shell, the re-arming of the firing mechanism and the feeding of a further, new cartridge from the tank to the cartridge chamber in the barrel.

The piston is usually centrally guided, through an interposed seal bushing, on a stationary rod which supports a cover for the tubular tank. The cylinder is closed, on the opposite end from the direction the piston moves when thrust by the gas, by an excess pressure valve placed around a coaxial stem to the guide rod of the piston.

However, in the known solutions the gasses which flow into the cylinder from the barrel and which may contain and/or carry impurities and dirt particles, come into direct contact with the guide rod and the seal bushing between the piston and rod. The result is that as the shotgun is operated, impurities and foreign particles tend to accumulate on the rod and in time hinder the correct functioning of the system, limiting the movement of the piston, causing wear on the bushing and jeopardizing the sealing capacity of the latter.

The present invention is aimed at correcting this inconvenience and disadvantage of the known technique.

It is in fact the aim of the present invention to propose a gas operated system for shotguns equipped with a means to prevent the flow of gas from the barrel to the cylinder coming directly into contact with the piston drive rod so that this rod is less subject to or completely free from deposits of impurities and dirt, and that nonetheless this dirt can easily be expelled from the cylinder.

Another aim of the invention is to propose a gas operated system for shotguns equipped with a means of scraping, which moves together with the piston and is able to remove the impurities from the guide rod of the piston so as to ensure optimum movement at all times of the latter and not jeopardize the action of the seal bushing.

A further aim of the invention is to achieve a gas operated system for shotguns of the type mentioned above in which there is at the same time a way of preventing the gas from coming into direct contact with the guide rod of the piston and a means of scraping in order to keep this rod clean, preventing any dirt particles from depositing.

These aims are reached in a shotgun with a gas operated system incorporating a protective fixed flap placed in front of the gas entrance from the barrel into the cylinder and partially covering the guide rod of the piston, and a scraper blade positioned and operating around the surfaces of the guide rod and which moves together with the piston along the rod itself.

More details of the invention will however become clearer from the description made in reference to the enclosed drawing, in which the only FIGURE shows a cross section of only some parts of the shotgun housing the improvements according to the invention.

The drawing shows a part of a barrel 11 of a shotgun with a cylinder 12 attached with a chamber 12' in which a piston 13 travels. The interior of the barrel 11 connects to the internal chamber of the cylinder 12 by means of a hole 14 so that a part of the propellant gas which forms on firing the cartridge flows, due to an operation of the piston 13, from the barrel to the cylinder.

Furthermore piston 13, in cylinder 12, is centrally guided by the interposition of a seal bushing 15, on a stationary rod 16 attached to a cover 17 closing a tank—not shown. Piston 13, when idle, is held in the forward position by a return spring, not shown, but which acts in the direction of the arrow R in the drawing. Under the action of the thrust from the gas coming from the barrel, the piston moves back (towards the right in the drawing) to carry out the provided functions.

At the front (left in the drawing), the chamber of the cylinder 12 is closed by an excess pressure valve 18, with bleeder holes.

This valve is held by a stem of valve 19 and usually kept in a closed position by an adjustable spring—not shown—acting according to the F arrow in the drawing. The stem of valve 19 is assembled concentrically on the guide rod 16 of piston 13.

The gas operated system described above includes a protective flap 20 as an element of improvement which can be achieved as an extension of the valve stem 19 and which extends into the cylinder towards the piston, on the front of the latter. The protective flap 20 is positioned at the front of the entrance of the gas into the cylinder and partially covers the guide rod at an angle of about 180°.

The free end of flap 20 finishes in a deflector 21 facing radially towards the external.

Another improvement is that the system can include a scraper blade 22 encircling the external surface of the guide rod 16 and acting on this subsequent to the movements of the piston along the rod itself. For this purpose, and to the advantage of the system, the scraper blade is either made from, or carried by, the seal bushing 15 which slides together with the piston along the guide rod.

Summarizing, the effects of the protective flap 20 with the deflector edge are:

- To prevent the stationary guide rod 16 from being directly exposed to the gas flow coming from the cylinder 12 which may contain and carry dirt liable to deposit on the rod itself;
- To create turbulence in the gas flow inside the cylinder so as to encourage the expulsion of the dirt particles through the bleeder holes of the valve and from the normal discharge space 23 of the cylinder which is opened when the piston is at the end of its return stroke.

The effect of the scraper blade 22 is to make the seal bushing 15 self-cleaning, helping to remove and eliminate any impurities present on the guide rod 16 at each forward and return stroke of the piston to the rest position.

What is claimed is:

1. Gas operated shotgun including a barrel (11) with an interior, a cylinder (12) attached to said barrel and having an internal chamber, a piston (13) moving in said chamber of the cylinder between a forward rest position and an active retracted control position for certain functional operations of the shotgun, where the inside of the barrel communicates with the internal chamber of the cylinder through at least one passageway (14) of a part of the propulsion gasses formed from a cartridge being fired from said barrel in said cylinder due to the movement of the piston from the forward rest position to the active retracted position, where the piston is guided centrally by an interposed seal bushing (15), on a stationary guide rod (16) coaxial to the cylinder and where said guide rod carries a stem (19) with an excess pressure valve (18) positioned to close the cylinder (12) on the opposite side to the one the piston is travelling towards during its active retracting stroke, characterised by a protective flap (20) which extends into the cylinder chamber towards the piston on the front of the same, which is placed in front of the gas entrance hole (14) in said cylinder chamber and which partially covers the guide rod (16) of the piston.

2. Shotgun according to claim 1, where said protective flap (20) is an extension of the stem (19) of the excess pressure valve (18).

3. Shotgun according to claim 1, where said protective flap (20) finishes in a deflector edge in proximity with the guide bushing of the piston when the latter in the rest position.

4. Shotgun according to claim 1 where the protective flap (20) covers the guide rod at an angle of 180°.

5. Shotgun according to claim 1 including also a scraper blade (22) which moves with the piston and which encircles and acts on the surface of the guide rod.

6. Shotgun according to claim 5, where said scraper blade (22) is an integral part of the seal bushing (15) between the piston and guide rod.

7. Gas operated shotgun made up of a barrel (11) with an internal section, a cylinder (12) attached to said barrel and having an internal chamber, a piston (13) moving in said chamber of the cylinder between an advanced rest position and a retracted active control position of certain operational functions of the shogun, where the internal section of the barrel communicates with the internal chamber of the cylinder through at least one inlet (14) for a part of the propulsion gas formed by the firing of a cartridge from said barrel in said cylinder because of the movement of the piston from the advanced rest position to the retracted active position, where the piston is guided centrally, through the interposition of a seal bushing (15), on a fixed guide rod (16) coaxial to the cylinder and where said guide rod has a stem (19) with an excess pressure valve (18) positioned to close the cylinder (12) on the opposite end to the one the piston moves towards during the active retraction stroke, characterized by a protective flap (20) which extends into the chamber of the cylinder towards the piston on the front of the same, which is in front of the entrance passageway (14) of the gas in said chamber of the cylinder and which partially covers the guide rod (16) of the piston, and a scraper blade (22) which moves with the piston and which encircles and acts on the surface of the guide rod (16).

8. Shotgun according to claim 7, where said protective flap (20) is an elongation of the stem of the excess pressure valve, placed in front of the gas entrance hole in the cylinder and covers the guide rod along a part of its circumference, and where said protective flap (22) is an integral part of the seal bushing between the piston and guide rod.

* * * * *